United States Patent [19]

Pfaff et al.

[11] Patent Number: 4,679,035

[45] Date of Patent: Jul. 7, 1987

[54] TRI-SIGNAL ELECTROMAGNETIC ARTICLE SURVEILLANCE SYSTEM

[75] Inventors: Paul H. Pfaff, Lighthouse Point; Richard N. Spagna, Pompano Beach; Robert A. Clucas, Lauderdale-By-The-Sea; Paul Coulson, Deerfield Beach; Ezra D. Eskandry, Miami, all of Fla.

[73] Assignee: Sensormatic Electronics Corporation, Deerfield Beach, Fla.

[21] Appl. No.: 760,680

[22] Filed: Jul. 30, 1985

[51] Int. Cl.[4] ..... G08B 13/18

[52] U.S. Cl. ..... 340/572; 342/27

[58] Field of Search ..... 340/572; 343/6.8 LC, 343/6.8 R; 342/27

[56] References Cited

U.S. PATENT DOCUMENTS

| | | | |
|---|---|---|---|
| 3,895,368 | 7/1975 | Gordon et al. | 340/572 |
| 4,139,844 | 2/1979 | Reeder | 340/572 |
| 4,206,453 | 6/1980 | Williamson | 340/572 |
| 4,212,002 | 7/1980 | Williamson | 340/572 |

*Primary Examiner*—Glen R. Swann, III

*Attorney, Agent, or Firm*—Robin, Blecker & Daley

[57] ABSTRACT

In a method for electronic surveillance of articles in a given area, one preselects first and second zones in the area respectively for surveillance and non-surveillance and affixes to the articles devices adapted to provide a first output indicative of an alarm condition upon receipt of first predetermined signals and further adapted to provide a second output not indicative of an alarm condition upon receipt of such first signals together with second predetermined signals diverse from the first signals. One transmits the first signals in the area, and transmits the second signals at least into the second zone, such that devices on articles present in the second zone provide the second output. The first signals may be microwave and modulated low-frequency signals. The second signals may be unmodulated low-frequency signals. Systems and antenna configuration are also shown.

29 Claims, 5 Drawing Figures

TRI-SIGNAL ELECTROMAGNETIC ARTICLE SURVEILLANCE SYSTEM

FIELD OF THE INVENTION

The present invention relates generally to article pilferage control and pertains more particularly to an enhanced method and system for such usage.

BACKGROUND OF THE INVENTION

The electronic surveillance art has seen continued advance in the past decade in both sensitivity and consistency of detection of suitably tagged articles in unauthorized transport thereof from secured areas.

One significant advance is disclosed in commonly assigned U.S. Pat. No. 3,895,368 issued on July 15, 1975 to Gordon et al., wherein joint high and modulated low frequency fields, respectively radiant electromagnetic and electrostatic, are established in the surveillance or control zone of an area also including an article display zone. Articles of concern have receptor-reradiator devices secured thereto and such devices have capability for transmitting an output signal having preselected correspondence to energy incident thereon.

In the Gordon et al. systems, the high-frequency field results from a continuous wave (CW) microwave frequency transmitter, e.g., operating at nine hundred and fifteen megahertz, and the low frequency field results from a transmitter operating at a substantially lower frequency with a time-based, frequency-modulation (f-m) characteristic. An alarm or other indication of unauthorized article presence in the surveillance zone is provided when a receiver receives a receptor-reradiator output signal transmission which includes content corresponding to the high and low frequencies and detects the modulation characteristic of the latter. Output alarm indication is preferably delayed in the '368 patent until there is a given repetitive occurrence of receipt of the proper detected alarm signal.

Alternative effective alarm condition sensing is achieved in another commonly assigned patent, U.S. Pat. No. 4,139,844 issued to Reeder on Feb. 13, 1979, wherein different modulated low-frequency signals are propogated with the microwave energy in the surveillance zone. Here, an alarm condition occurs only where a signal is detected which has content corresponding to a composite characteristic of the plural low frequency signals.

Fundamental to these systems of the assignee hereof is a recognition of need for a high-frequency carrier, the microwave transmission, and of the inherent difficulties of limiting the transmission pattern thereof, and of the detectable alarm intelligence therewith, through modulation, of a low-frequency carrier whose propagation pattern is comparatively controllable. Control of the pattern of the low frequency field is thus practical and gives rise to some measure of distinction as between the surveillance zone and an adjacent article display zone in which tagged articles are to be present without creating an alarm condition.

A phenomenon of wave propagation is that pattern control is inexact and a so-called "over-range" characteristic is inherent, i.e., patterns will extend beyond anticipated or planned ranges, dependent upon various factors, such as the presence of pattern-influencing extraneous objects. Mechanical shielding, e.g., conductive screens, have provided a degree of limitation on over-range, but are generally undesirable, based on physical size, aesthetic requirements and the impracticality of physically shielding large areas. In the absence of such screening, tagged articles outside of the surveillance zone can give rise to alarm indication and full usage of an article display area may accordingly be diminished.

One known approach to overrange control is shown in U.S. Pat. No. 4,212,002, issued to Williamson on July 8, 1980. In the system of the '002 patent, a high-frequency field is established in an area and a first low-frequency field with a modulation characteristic is established in a surveillance zone. A second low-frequency field with a modulation characteristic is established adjacent the boundary of the surveillance zone by antenna means transmitting energy directionally away from the surveillance zone. The frequency of the second field signal is distinct from that of the first field, such that a frequency-modulation receiver at the surveillance zone can discriminate between receptor-reradiator output transmissions from articles in the surveillance zone and in the boundary zone. The operative mechanism is the f-m receiver's "locking on" to the strongest of the different frequency carriers within its pass band. Transmitters of articles in the adjacent boundary zone will provide output signals having the second field carrier dominating over the first field carrier, and accordingly will not cause alarm indication. Upon receiving such transmissions from the boundary zone, the receiver operates in its customary mode, i.e., detecting the modulation characteristic of the second frequency carrier. Output may accordingly be provided, advising of the approach of an article toward the surveillance zone. In applicants' view, the operative mechanism of the '002 system, namely, the need to lock on to plural carrier frequencies, can give rise to a lessening of sensitivity of the receiver to transmissions issuing in the surveillance zone.

SUMMARY OF THE INVENTION

The present invention has as its primary object the provision of improved methods and systems for electronic article surveillance.

A particular object of the invention is to permit enhanced control of overranging in article surveillance systems.

In attaining these and other objects, the invention introduces in the type of system discussed above in connection with the Gordon et al '368 patent active circuit means for electronically shielding a zone (article display zone) preselected for tagged article presence without attendant generation of alarm conditions. By this measure, although such article display zone may have transmission levels therein, of both the microwave energy and the modulated low-frequency energy of magnitude which would, in the absence of the electronic shielding, cause alarm indication, the detector station receiver, in accordance with the invention herein, is rendered selectively insensitive to the same and an alarm condition is not generated.

In broad aspect, the invention provides system and method for electronic surveillance of articles in a given area, comprising the steps of preselecting first and second zones in said area respectively for surveillance and non-surveillance, affixing to the articles devices adapted to provide a first output indicative of an alarm condition upon receipt of first predetermined signals and further adapted to provide a second output not indicative of an alarm condition upon receipt of such first signals together with second predetermined signals diverse from the first signals, transmitting the first signals in the area, and transmitting the second signals into adjacent portions of the first and second zones, such that said devices on articles present in such adjacent portions provide the second output. The first signals may be the microwave and modulated low-frequency signals of the '368 patent. The second signals may be unmodulated low-frequency signals.

In a preferred practice in accordance with the invention, for electronic article surveillance in an area having a surveillance zone and an article display zone adjacent said surveillance zone, a method includes the steps of: transmitting into the area a high-frequency signal comprised of an unmodulated carrier and a primary low-frequency signal comprised of a carrier with a modulation characteristic; and affixing to articles in the area receptor-reradiator devices adapted for transmitting output signals having content corresponding to transmitted signals incident thereon. Receiver-detector means are disposed in the surveillance zone for receiving the receptor-reradiator means output signals, the receiver-detector means having capability for providing output indication of the modulation characteristic therein if same is in predetermined ratio to low-frequency carrier content thereof, i.e., is above a given threshold level assigned for detection purposes, and thereupon generating an alarm condition. The method further involves transmitting into the area an auxiliary low-frequency signal comprised of an unmodulated carrier and thereby selectively increasing low-frequency carrier content of the receptor-reradiator means output signals for receptor-reradiator means in the article display zone to thereby cause the ratio of the modulation characteristic in such selected receptor-reradiator means output signals to low-frequency carrier content thereof to be less than such predetermined ratio and thereby precluding generation of the alarm condition.

The mechanism underlying the practice of the invention will be seen not to involve a frequency hunting or "lock on" shifting as in the Williamson patent above discussed. Rather, the invention looks, in the receiver-detector to the quantum of total low-frequency carrier present and the modulation characteristic is not detectable where large carrier content is present, as contributed to by the auxiliary field. As an article is carried into the surveillance zone, however, lessened auxiliary field carrier content is present in the receiver and modulation characteristic detection occurs.

The frequency of the auxiliary low-frequency carrier is desirably equal to that of the primary low-frequency carrier. The modulation characteristic of the primary low-frequency signal is selected to be a time-permutative characteristic. In one preferred practice discussed in detail below, the primary low-frequency transmission is a one hundred kilohertz carrier which is frequency-shift-keyed at eight hundred hertz. The auxiliary low-frequency transmission is an unmodulated one hundred kilohertz carrier.

The method is further desirably practiced through the use of first, second and third antennas for transmission respectively of the high-frequency signal, the primary low-frequency signal and the auxiliary low-frequency signal, and the third antenna is located generally at a line of demarcation between the surveillance zone and the article display zone and may be made visible to provide indication of such demarcation.

Systems of the invention are configured for practice of the described method, as below shown and discussed.

The foregoing and other objects and features of the invention will be further understood from the following detailed description of preferred embodiments thereof and from the drawings wherein like reference numerals identify like parts throughout.

DESCRIPTION OF PREFERRED EMBODIMENTS AND PRACTICES

Figure 1:
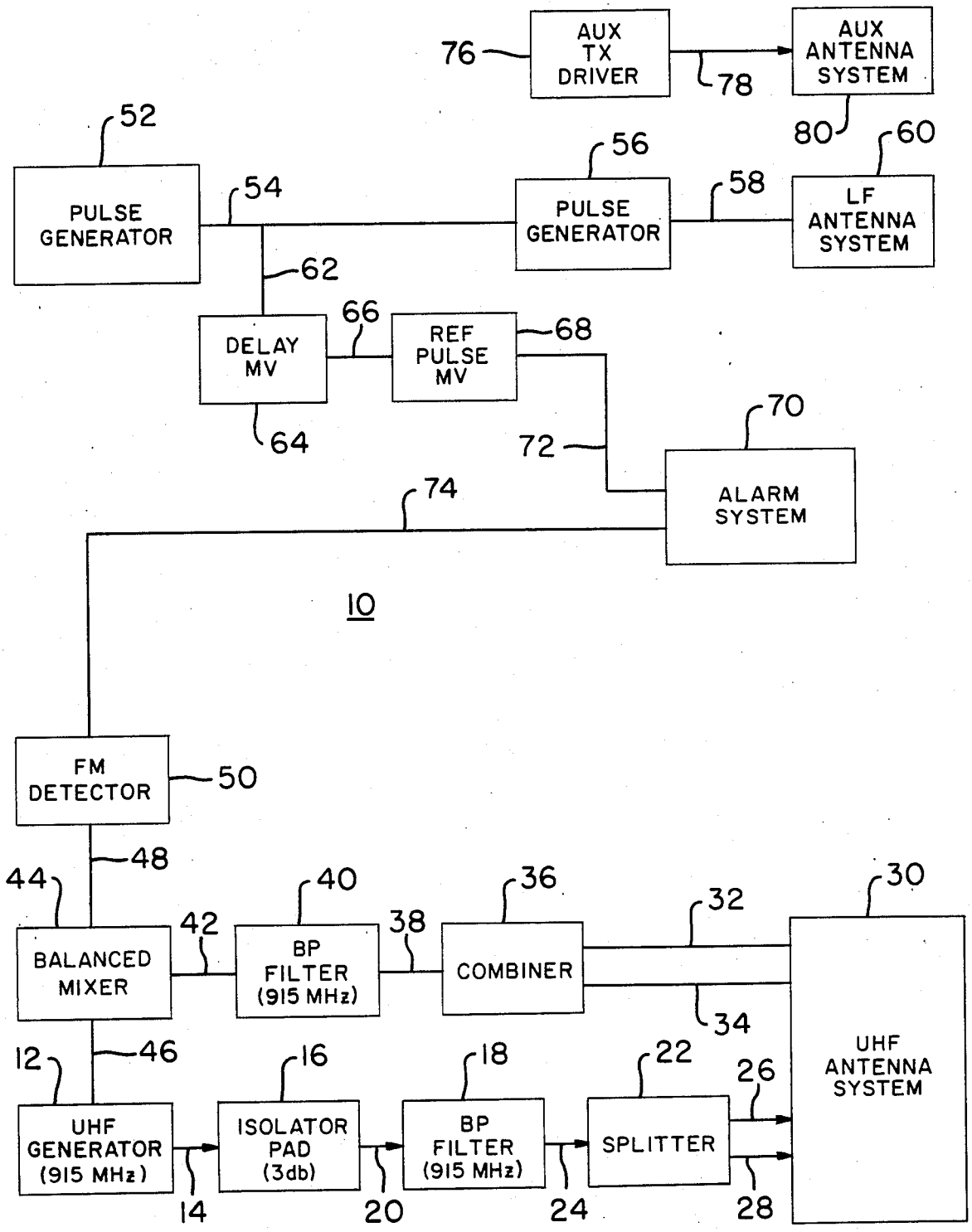
FIG. 1 is a block diagram of a system in accordance with the invention.

Referring to FIG. 1, system 10 includes components akin to those of the Gordon et al. '368 patent to which incorporating reference is hereby made. High-frequency UHF generator or transmitter 12 may operate at nine hundred and fifteen or twenty four hundred and fifty megahertz, which are known microwave frequencies for use in surveillance practices. The output of high-frequency generator 12 is applied over line 14 to a 3 db isolator pad 16. A bandpass filter 18 is connected to pad 16 by line 20 and feeds splitter 22 over line 24. Filter 18 has a center frequency of nine hundred and fifteen megahertz where system UHF transmission is at the first above-noted frequency. Splitter 22 has output lines 26 and 28 connected to UHF antenna system 30. System 30 is depicted in the '368 patent as including individual transmitting antennas for connection respectively to lines 26 and 28, the antennas being mounted on opposite sides of the area to be controlled in corresponding enclosures or pedestals, thereby establishing an electromagnetic field of microwave energy in the controlled space therebetween.

A second pair of antennas are in UHF antenna system 30 and are mounted across the controlled space from the corresponding transmitting antennas for receipt of signals existing in the controlled space and for furnishing same respectively on output lines 32 and 34 to combiner 36, whose output is fed over line 38 to bandpass filter 40. The output of filter 40 is applied by line 42 to one input of balanced mixer 44. A second mixer 44 input is furnished with a signal at nine hundred and fifteen megahertz from a low power level output of generator 12 over line 46. The output of mixer 44 is conveyed by line 48 to frequency-modulation detector 50.

Turning to the upper portion of FIG. 1, a voltage-controlled pulse generator 52 applies output pulses on line 54 having a frequency of eight hundred hertz for frequency-shifting pulse generator 56. Generator 56 has a center frequency of one hundred kilohertz and, at the rate of the line 54 pulses, deviates by plus and minus one and three-tenths kilohertz. The output of generator 56 is fed by line 58 to low-frequency antenna system 60, also shown in the '368 patent to have a resonant-type low pass filter connected to line 58, whereby the square wave input is converted to a sinusoidal signal of like frequency. The filter output is power amplified and applied through step-up transformers to respective foil antennas. The foils are located in the above-noted pedestals on opposed sides of the area being controlled and establish an electrostatic field to ground.

Line 62 applies the output of generator 52 to delay multivibrator 64, the output of which is fed by line 66 to the input of a reference pulse multivibrator 68. The output of multivibrator 68 is furnished with that of detector 50 to alarm system 70 over lines 72 and 74.

Alarm system 70 may be of type shown in the '368 patent, i.e., having logic circuitry to compare the inputs received on lines 72 and 74 and noting correspondence therebetween in a repetitive pattern and thereupon providing output alarm indication.

Completing the circuit elements of FIG. 1, the system of the invention includes auxiliary transmission driver 76, which generates sinusoidal output at one hundred kilohertz, without modulation. Driver 76 furnishes its output over line 78 to auxiliary antenna system 80 which, as discussed below, may comprise an antenna in the form of an extrusion placed selectively in relation to the above discussed antennas.

Figure 2:
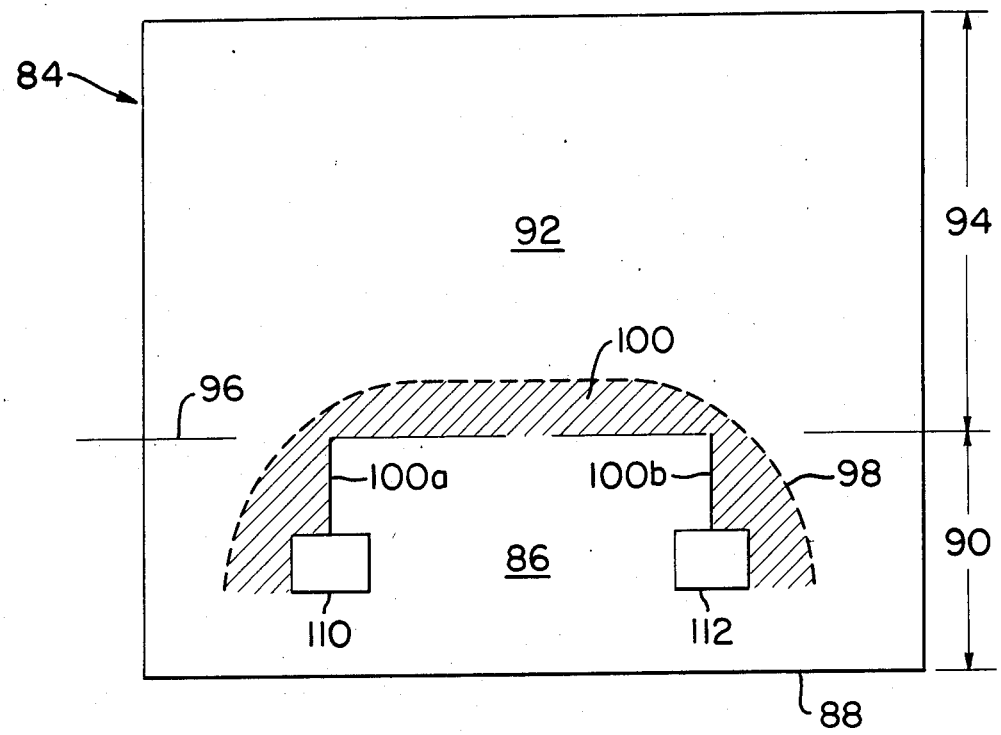
FIG. 2 is a schematic diagram illustrative of zone definition in a surveillance area without the auxiliary field transmitter.

Referring to FIG. 2, In typical electronic surveillance planning, a retail area 84 may have a surveillance zone 86 selected to extend from storefront 88 to depth 90 and an article display zone 92 extending rearwardly from the exit zone in depth 94. Clear definition of a line 96 of demarcation between the zones is evidently desirable. Thus, the retailer desires to maximize article display area while, at the same time, needs practical assurance that tagged articles may be carried freely throughout such zone 92 without activation of an alarm.

In presently commercialized systems, the energy radiation pattern of high and low frequency levels which causes receptor-reradiator transmissions, is not precisely defined and is typically of configuration indicated at 98 in the FIG. 2 plan view of retail area 84. Cross-hatched area 100 thus represents an active area within such field rearward of desired demarcation line 96 and sideward of lines 100*a* and 100*b*.

Tagged articles carried into area 100 are thus within the alarm condition zone and area 100 is manifestly unusable through for article display purposes.

Figure 3:
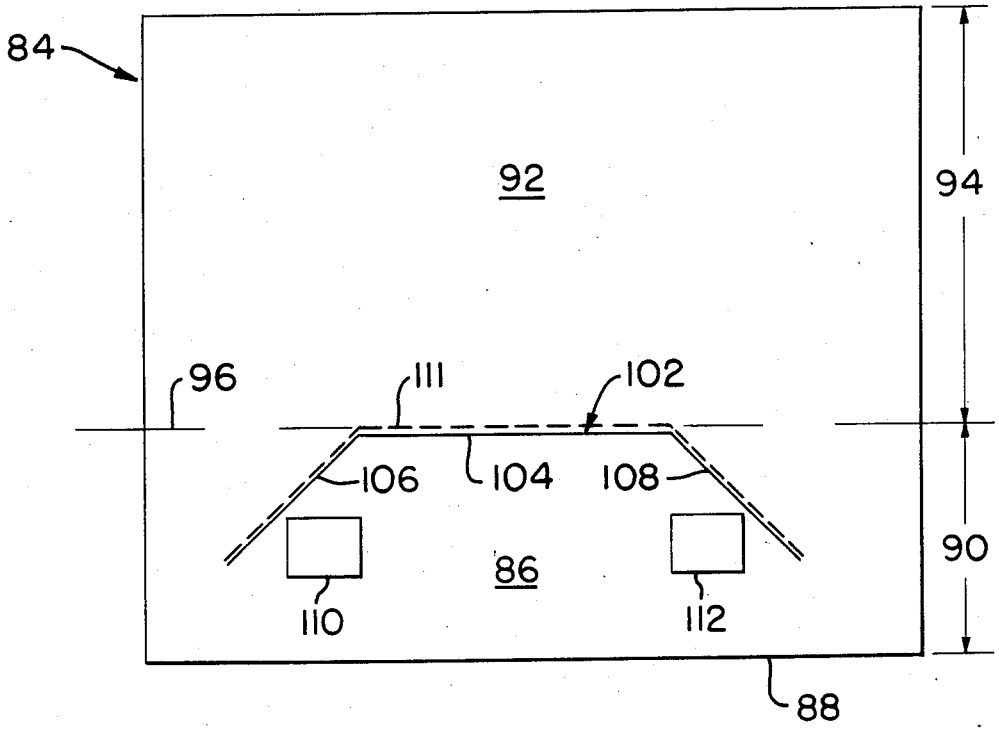
FIG. 3 is a schematic diagram illustrative of zone definition in a surveillance area and placement of radiators therein for implementing the FIG. 1 system.

Turning to FIG. 3, auxiliary low frequency antenna 102 of the FIG. 1 auxiliary antenna system is shown as having a rectilinearly extending central section 104 and end sections 106 and 108 extending from central section 104 slightly outwardly of pedestals 110 and 112. Antenna 102 is positioned with its central section in alignment with zone demarcation line 96. By system setup below discussed, it is found that the system field of sensitivity can now be conformed to that indicated at 111 in FIG. 3, i.e., ending rearwardly at demarcation line 96 and of configuration corresponding to the physical and hence observable outline of antenna 102. In placement, antenna 102 may be suspended from the ceiling of retail area 84 or may be otherwise elevated with respect to the antennas of the high and modulated low frequency field antenna systems. As such, antenna 102 provides a practical visual embodiment of demarcation line 96 and a retailer is given knowledge of the extent of the system field of sensitivity, and may accordingly both maximize article display usage in zone 92 adjacent the demarcation line and enjoy the comfort of minimum, if any, alarm conditions occurring in display area 92.

Figure 4:
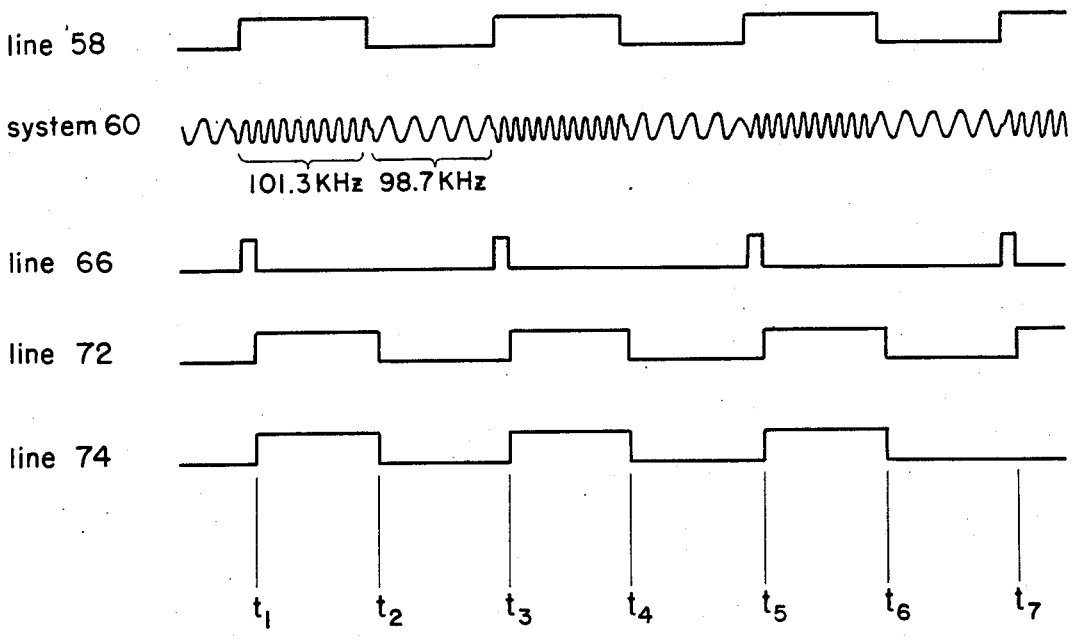
FIG. 4 depicts signal waveforms at various stages of the FIG. 1 system in part under operating conditions with and without the auxiliary field transmitter.

In system setup practice, one first delineates surveillance zone 86 and system-insensitive, article display zone 92, identifying thusly the desired location of demarcation line 96. Antenna 102 is now located in substantial registry with line 96. The system, except for auxiliary transmission driver 76 of FIG. 1, is energized, thereby effecting temporarily a field of distribution 98 of FIG. 2. A tag is now disposed in cross-hatched area 100 rearwardly of line 86. The leftward signals of FIG. 4 will now occur. Thus, the top signal trace, line 58 of FIG. 1, will be pulsed HI (+d. c. voltage) from t1 to t2 and from t3 to t4, and will be LO (d. c. ground potential) from t2 to t3. Antenna system 60 will furnish a one hundred and one and three-tenths (101.3) kilohertz burst between t1 and t2 and between t3 and t4 and will furnish a ninety-eight and seven-tenths (98.7) kilohertz burst during the alternate time periods, as indicated. Line 66 of FIG. 4 shows the pulse output provided by delay multivibrator 64 of FIG. 1. It will be seen that the leading edge of the pulse coincides with the leading edge of the positive going pulse output of pulse generator 52 on line 54. The trailing edge of the pulse provided by multivibrator 64 may be adjustable by appropriate means not shown. The delay produced by multivibrator 64 is thereby adjusted to be equal to the normal delay encountered by the signals in passing through the equipment both into the electrostatic (low-frequency) field and back on the modulated carrier through the balanced mixing and detecting circuitry.

The trailing edge of the pulse on line 66 is employed to trigger the reference pulse multivibrator 68 of FIG. 1, whose output is shown on line 72 in FIG. 4. The width of the pulse produced by this multivibrator may be adjustable by means not shown so that such pulse width coincides with the pulse width detected from an actual tag in the controlled space.

The receptor-reradiator of the tag above placed in cross-hatched area 100 of FIG. 2 may comprise the commercially known combined dipole antenna with diode. It will develop a modulated output in correspondence with energy incident thereof, inclusive of the modulation characteristic of the low-frequency transmission, the low-frequency carrier and the microwave transmission. On receipt by the FIG. 1 system, such signal is applied to balanced mixer 44. In known manner, mixer 44 will remove the microwave frequency carrier component and supply the 101.3 and 98.7 kilocycle components as detected thereby over line 48 to f-m detector 50 for conversion to a square wave pulse having the form shown at line 74 in FIG. 4. An alarm condition will be seen to be present in FIG. 4, since the signals on lines 72 and 74 are in correspondence.

During the time period t4–t5 of FIG. 4, in the setup example at hand, auxiliary transmission driver 76 of FIG. 1 is energized at any given output power level, applying to line 78 a continuous wave at unmodulated one hundred kilocycles. Assuming such power level to be below that required for alarm suppression, energization of driver 76 has as yet no consequence; the event on line 74 during t1–t3 and t3–t4 recurring during t5–t6.

At t6, the output of driver 76 is increased to such higher level as will bring on the event at t7, i.e., wherein, despite continous microwave transmission and a concurrent burst on line 58, line 74 does not step from LO to HI in cadence with line 72. At the receiver, sufficient energy of unmodulated low-frequency carrier has been transmitted by the tag to the receiver as to decrease its sensitivity to the alarm condition signal present but dwarfed in the receiver input. The ratio of modulation characteristic in the received signal to carrier energy is below that ratio which is necessary to attain detection threshold of the receiver. As, however, such system setup article, and any subsequently tagged article is transported increasingly forwardly of demarcation line 96, same receives and reradiates substantially less auxiliary (unmodulated) low-frequency energy, whereupon the ratio of modulation characteristic to low-frequency carrier in the receiver increases to cause alarm condition occurrence.

Figure 5:
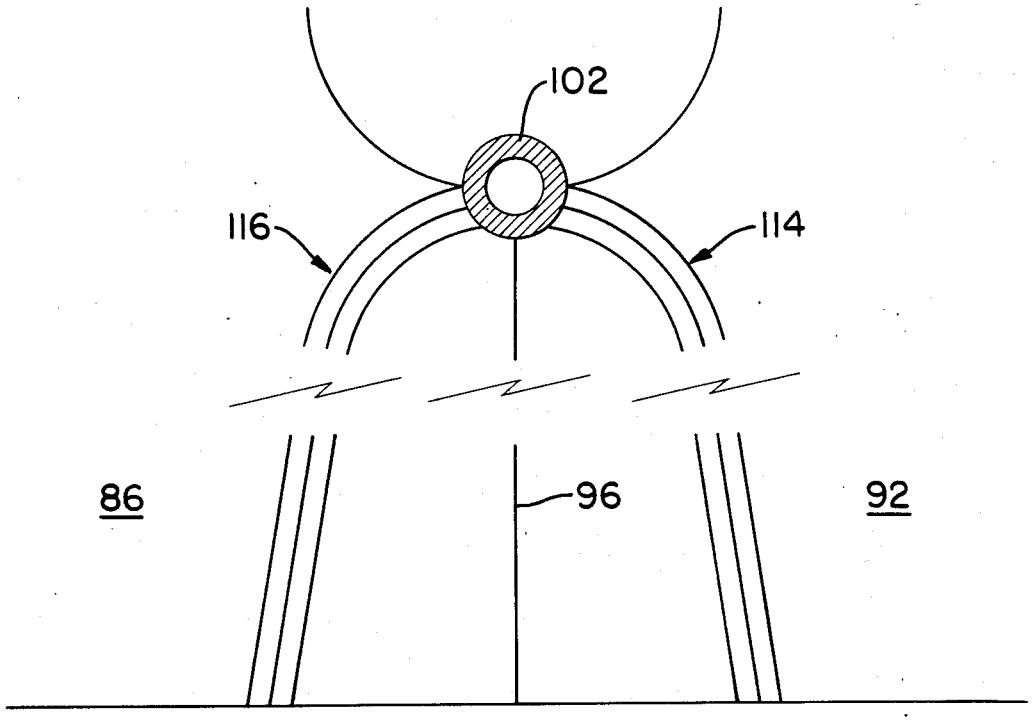
FIG. 5 is a side sectional view of the auxiliary field antenna shown in typical placement and with indication of the field generated thereby.

Turning to FIG. 5, the foregoing is seen graphically, Antenna 102 is shown in section and comprises a metal pipe, obtained preferably by extrusion. Field lines 114 and 116 issue radially of the antenna and bend to ground in respective adjacent portions of surveillance or control zone 86 and display or uncontrolled zone 92. To the extent that some modulated low-frequency may issue from zone 86 into zone 92, the same is dominated, within such adjacent surveillance zone portions, by the antenna 102 output. However, as the article with tag is moved to the outskirts of the illustrated field lines, i.e., leftwardly into the depth of the controlled zone, unmodulated carrier is decreasingly received and the modulated carrier predominates.

Various changes to the particularly described embodiment and variations in the discussed methods may be introduced without departing from the invention. By way of example, the auxiliary antenna 102 may stand upright with and adjacent the pedestals containing the other antennas, or may be disposed on a floor, with like effects as above discussed. Also, it will be appreciated that the invention may be introduced in or practiced with electronic surveillance systems other than the above discussed system of the '368 patent. By way of example, such system may employ single antennas in place of the antenna pairs above discussed, in which case each such antenna is employed alternately in a transmit and a receive mode. Likewise, alarm system 70 above is typical and may be repaced by other signal processing practices. Accordingly, the preferred embodiments and methods above are intended in an illustrative and not in a limiting sense. The true spirit and scope of the invention is set forth in the following claims.

We claim:

1. A system for electronic article surveillance in an area having a surveillance zone and an article display zone adjacent said surveillance zone, said system including:

(a) means for transmitting into said area a high-frequency signal;

(b) means for transmitting into said area a primary low-frequency signal comprised of a carrier with a modulation characteristic;

(c) receptor-reradiator means affixed to articles in said area for transmitting output signals having content corresponding to transmitted signals incident thereon and inclusive of said modulation characteristic and such low-frequency carrier;

(d) receiver-detector means in said surveillance zone for receiving such receptor-reradiator means transmitted signals and having capability for providing output indication of said modulation characteristic therein if same is in predetermined ratio to low-frequency carrier content thereof and thereupon to generate an alarm condition; and (e) means for transmitting into said area an auxiliary low-frequency signal comprised of an unmodulated carrier for selectively increasing low-frequency carrier content of said receptor-reradiator means transmitted signals for receptor-reradiator means in said article display zone to cause the ratio of said modulation characteristic in such selected receptor-reradiator means transmitted signals to low-frequency carrier content thereof to be less than said predetermined ratio and thereupon to preclude generation of said alarm condition.

2. The system claimed in claim 1 wherein said means (e) transmits said auxiliary signal at the frequency of said means (b) carrier.

3. The system claimed in claim 2 wherein said modulation characteristic of said means (b) signal is a time-permutative characteristic.

4. The system claimed in claim 3 wherein said modulation characteristic of said means (b) signal is a frequency-modulated characteristic.

5. The system claimed in claim 1 wherein said means (a), (b) and (e) include respective first, second and third antenna means for transmission respectively of said high-frequency signal, said primary low-frequency signal and said auxiliary low-frequency signal, said third antenna means being located generally at a line of demarcation between said surveillance zone and said article display zone.

6. The system claimed in claim 5 wherein said third antenna means is located at higher elevation than said first and second antenna means.

7. The system claimed in claim 5 wherein said third antenna means is visibly discernible, thereby providing visibility of said demarcation line.

8. The system claimed in claim 5 wherein at least said second antenna means are a plurality of second antennas and wherein said third antenna means is of a configuration having a central expanse generally in facing relationship to said second antennas and end sections outwardly of of said second antennas.

9. A method for electronic article surveillance in an area having a surveillance zone and an article display zone adjacent said surveillance zone, said method including the steps of:

(a) transmitting into said area a high-frequency signal;

(b) transmitting into said area a primary low-frequency signal comprised of a carrier with a modulation characteristic;

(c) affixing to articles in said area receptor-reradiator devices adapted for transmitting output signals having content corresponding to transmitted signals incident thereon and inclusive of said modulation characteristic and such low-frequency carrier;

(d) disposing receiver-detector means in said surveillance zone for receiving said receptor-reradiator means output signals and having capability for providing output indication of said modulation characteristic therein if same is in predetermined ratio to low-frequency carrier content thereof and thereupon generating an alarm condition; and (e) transmitting into said area an auxiliary low-frequency signal comprised of an unmodulated carrier and thereby selectively increasing low-frequency carrier content of said receptor-reradiator means output signals for receptor-reradiator means in said article display zone to thereby cause the ratio of said modulation characteristic in such selected receptor-reradiator means output signals to low-frequency carrier content thereof to be less than said predetermined ratio and thereby precluding generation of said alarm condition.

10. The method claimed in claim 9 wherein the frequency of said auxiliary low-frequency signal is selected to be the same as the frequency of said primary low-frequency signal.

11. Themethod claimed in claim 9 wherein said modulation characteristic of said primary low-frequency signal is selected to be a time-permutative characteristic.

12. The method claimed in claim 11 wherein said modulation characteristic is selected to be a frequency-modulated characteristic.

13. The method claimed in claim 9 wherein said steps (a), (b) and (e) are practiced through the use of first, second and third antenna means for transmission respectively of said high-frequency signal, said primary low-frequency signal and said auxiliary low-frequency signal, and wherein said third antenna means is located generally at a line of demarcation between said surveillance zone and said article display zone.

14. The method claimed in claim 13 wherein said third antenna means is located at higher elevation than said first and second antenna means.

15. The method claimed in claim 13 wherein said third antenna means is rendered visibly discernible, thereby providing visibility of said demarcation line.

16. The method claimed in claim 13 wherein at least said second antenna means are a plurality of second antennas and wherein said third antenna means is selected to be of a configuration having a central expanse generally in facing relationship to said second antennas and end sectiona outwardly of said second antennas.

17. A method for electronic surveillance of articles in a given area, comprising the steps of:

(a) preselecting first and second adjacent zones in said area respectively for surveillance and article display;

(b) affixing to said articles devices adapted to provide output transmission selectively upon receipt thereby of predetermined signals, said output transmission having signal content related to said predetermined signals;

(c) transmitting into said area first and second of said predetermined signals, respectively of high-frequency carrier and of low-frequency carrier with a modulating characteristic and transmitting a third of said predetermined signals of unmodulated low-frequency carrier and thereby distinct from both said first and second signals; and (d) generating an alarm indication selectively when said output transmissions of such article-affixed devices have signal content related to said first and second predetermined signals and content of said third predetermined signal in amplitude less than a pre-established amplitude level of said third predetermined signal.

18. The method claimed in claim 17 wherein said step (c) is practiced by transmitting said third signal in carrier frequency equal to said second frequency carrier.

19. The method claimed in claim 17 wherein said step (c) is practiced by effecting said transmissions of said first, second and third signals through the use of respective first, second and third antenna means, said third antenna means being placed at the location of such adjacency of said first and second adjacent zones.

20. The method claimed in claim 19 wherein said third antenna means is located at a higher elevation than said second antenna means.

21. The method claimed in claim 19 wherein said second antenna means comprises plural second antennas and wherein said step (c) is practiced by disposing a central section of said third antenna means at said demarcation line in facing relationship to said plural second antennas and providing said third antenna means with end sections outwardly of said plural second antennas.

22. A method for electronic surveillance of articles in a given area, comprising the steps of:

(a) preselecting first and second zones in said area respectively for surveillance and non-surveillance;

(b) affixing to said articles devices adapted to provide a first output indicative of an alarm condition upon receipt of first predetermined modulated signals and further adapted to provide a second output not indicative of an alarm condition upon receipt of such first signals together with second predetermined unmodulated signals of amplitude greater than a preselected amplitude level;

(c) transmitting said first signals in said area; and (d) transmitting said second signals selectively into adjacent portions of said first and second zones, such that said devices on articles present in said adjacent portions provide said second output.

23. The method claimed in claim 22 wherein said first signals are selected to comprise a high-frequency signal and a modulated low-frequency signal and said second signals are selected to comprise an unmodulated low-frequency signal.

24. The method claimed in claim 22 wherein said second signals are transmitted by use of an antenna located generally at a line of demarcation between said first and second zones.

25. The method claimed in claim 24 wherein said antenna is configured to transmit said second signals substantially in the same pattern in each of said adjacent portions of said first and second zones.

26. A system for electronic surveillance of articles in an area having respective controlled and uncontrolled zones, said system comprising:

(a) devices affixed to said articles and adapted to provide a first output indicative of an alarm condition upon receipt of first predetermined modulated signals and further adapted to provide a second output not indicative of an alarm condition upon receipt of such first signals together with second predetermined unmodulated signals of amplitude greater than a preselected amplitude level;

(b) means for transmitting said first signals in said area; and (c) means for transmitting said second signals selectively into adjacent portions of said first and second zones, such that said devices on articles present in said adjacent portions provide said second output.

27. The system claimed in claim 26 wherein said first signals comprise a high-frequency signal and a modulated low-frequency signal and said second signals comprise an unmodulated low-frequency signal.

28. The method claimed in claim 26 wherein said means (c) comprises an antenna located generally at a line of demarcation between said first and second zones.

29. The method claimed in claim 28 wherein said antenna is configured to transmit said second signals substantially in the same pattern in each of said adjacent portions of said first and second zones.

* * * * *